United States Patent [19]

Lowes

[11] Patent Number: 4,742,689

[45] Date of Patent: May 10, 1988

[54] CONSTANT TEMPERATURE MAINTAINING REFRIGERATION SYSTEM USING PROPORTIONAL FLOW THROTTLING VALVE AND CONTROLLED BYPASS LOOP

[75] Inventor: Albert R. Lowes, Auburn, Calif.

[73] Assignee: Mydax, Inc., Auburn, Calif.

[21] Appl. No.: 840,847

[22] Filed: Mar. 18, 1986

[51] Int. Cl.[4] ..... F25B 41/04

[52] U.S. Cl. ..... 62/197; 62/196.4; 62/205; 62/223; 62/224

[58] Field of Search ..... 62/197, 113, 513, 222, 62/223, 224, 225, 196.4, 205, 206

[56] References Cited

U.S. PATENT DOCUMENTS

| | | | |
|---|---|---|---|
| 2,461,760 | 2/1949 | Newton | 62/200 X |
| 3,201,950 | 8/1965 | Shrader | 62/197 |
| 3,313,121 | 4/1967 | Barbier | 62/197 |
| 3,324,674 | 6/1967 | Finnegan et al. | 62/223 X |
| 3,477,240 | 11/1969 | Thoren et al. | 62/197 X |
| 3,577,743 | 5/1971 | Long | 62/225 X |
| 3,803,864 | 4/1974 | Cooper | 62/223 X |
| 4,226,604 | 10/1980 | Weis | 62/197 X |
| 4,238,932 | 12/1980 | Schrader | 62/197 |
| 4,258,553 | 3/1981 | Kelly et al. | 62/197 X |
| 4,523,436 | 6/1985 | Schedel et al. | 62/222 |

OTHER PUBLICATIONS

The Singer Company, Bulletin TXV303D, 2/84 5M, Copyright 1984.

*Primary Examiner*—Harry B. Tanner

*Attorney, Agent, or Firm*—David B. Harrison

[57] ABSTRACT

A vapor-compression refrigeration system has a continuously operating compressor, with loading on the compressor varied in accordance with conditions and cooling needs. The system avoids any on/off cycling of the compressor or valves in the system, but instead keeps cooling and bypass valves open to varying and proportional degrees depending upon requirements. The system includes several bypass loops, for bypassing coolant fluid to a proportional degree when a desired temperature is approached in a body to be cooled; and when temperature of return gas to the compressor approaches a limit temperature beyond which the compressor should not operate. In the latter case, cool liquid is injected, while expanding and vaporizing, into the hot gas for cooling, to protect the compressor. The system operates in a very hot environment to effect the maximum cooling possible without exceeding the limits of the compressor, by reducing the refrigerant flow to the evaporator to continue operating at reduced load, reducing more and more of the cooling flow as the desired set point temperature is approached and controlling bypass flow to maintain evaporator pressure or temperature. Proportional flow valves used in the system enjoy long life due to the absence of stressful on/off cycling.

12 Claims, 11 Drawing Sheets

CONSTANT TEMPERATURE MAINTAINING REFRIGERATION SYSTEM USING PROPORTIONAL FLOW THROTTLING VALVE AND CONTROLLED BYPASS LOOP

BACKGROUND OF THE INVENTION

The invention relates to refrigeration, and more particularly to a vapor-compression refrigeration system utilizing a liquid-gas coolant with a continuously operating compressor, and with flow of coolant through a valve leading to the evaporator proportioned in response to sensed temperature of a fluid body being cooled at the evaporator. Extended load conditions and temperature ranges are provided by one or more bypass loops controlled by proportional flow valves.

In commercial refrigeration systems, cycling of the compressor causes cycling of refrigerant valves between open and closed positions; and this cycling leads directly to a great number of failures. In systems that use hot gas bypass, often called non-cyclic systems, referring to the fact that the system compressor does not shut off, there is a repeated cycling of valves between on and off positions. Typically, these are diaphragm valves, either thermostatic expansion valves (TEV) or automatic expansion valves (AEV), or solenoid valves. Due to metal fatigue failures start occurring at around 100,000 operations of diaphragm (metal bellows) valves, which can often occur in less than one year of operation for many compression chiller systems.

Other cyclic devices also fail. Solenoid valves fail to open or close after repeated cycling. Solenoid coils fail, as do coil drivers in temperature controllers. Home refrigerators, on the other hand, have a reputation for long life principally because they have no valves in their compression/expansion cycle loop. Instead, they are capillary expansion systems, without any throttling valve and without any cycling bypass valves. In such systems the compressor itself is cycled in order to control cooling.

One method often used in the prior art to reduce cycling failures was to deliberately undersize the refrigeration system for the anticipated load, so that the system would be kept running in the cooling mode most of the time. Another system included three separate compressors all on the same inflow and outflow lines. One, two or three compressors would be operational, depending on the load at any given time.

For very high ambients, conventional vapor-compression refrigeration simply has not been able to operate, particularly without water cooling, as in a refrigerated truck crossing the desert. Some such vehicles have had to use dead loss evaporative refrigeration systems in hot environments. In a dead loss system a cryogen such as liquid nitrogen passes through coils, evaporates and is exhausted to atmosphere as waste.

No refrigeration system of the prior art has resulted in the advantage of the present invention described below, with respect to avoidance of destructive valve cycling and bypassing of flow on a proportional basis in a manner resulting in smooth transitions of flow, continuous compressor operation even at no load, and protection of the system against overwork and overheating as limit levels of pressure drop or temperature are approached.

SUMMARY OF THE INVENTION WITH OBJECTS

A general object of the present invention is to provide an improved vapor-compression refrigeration system utilizing a liquid-gas coolant with a continuously operating compressor, and with flow of coolant through a valve leading to the evaporator proportioned in response to sensed temperature of a fluid body being cooled at the evaporator in a manner which overcomes limitations and drawbacks of the prior art.

A specific object of the present invention is to provide an improved vapor-compression refrigeration system in which continuous operation of a liquid-gas coolant compressor is achieved over extended load conditions and temperature ranges by the provision one or more bypass loops controlled by proportional flow valves.

Another specific object of the present invention is to avoid cycling stress in a continuous-compressor refrigeration system through the use of proportional-flow valves which open in accordance with the prevailing cooling demand.

A further object of the present invention is to hold a body of fluid very closely to a set point temperature over a wide range of load conditions.

One more object of the present invention is to enable a refrigeration system to operate at full cooling capacity when full cooling is demanded and to limit cooling capacity to a safe maximum level under conditions which would otherwise endanger the life of the compressor in the system, under which conditions operation of the compressor continues but cooling continues at a reduced capacity, even if temperature maintenance requirements are not met.

Still one more object of the present invention is to maintain a controlled and substantially constant degree of superheat in a refrigeration system.

Yet another object of the present invention is to provide a heat exchanger in the hot gas output compression line leading from the compressor by which expanded and cooled gas passing through a low cost vapor expansion valve may be warmed and fed back to the suction side of the compressor in a bypass loop in order to facilitate continuous operation of the compressor.

The present invention provides a liquid/gas coolant, vapor-compression refrigeration system having continuous compressor operation in which flow of coolant through an evaporator is proportioned to the temperature sensed in the body of fluid to be cooled at the evaporator. Continuous compressor operation may be facilitated by bypass of coolant flow around the evaporator as the desired fluid body temperature is reached, thereby avoiding damage to the gascooled compressor. Bypass cooling of the refrigerant before it reaches the compressor further enables continuous compressor operation at the limit of suction gas temperature without compressor failure.

A refrigeration system according to the invention may include a continuously operating compressor for compressing refrigerant, at least one condensor, and one or more throttling valves for controlling flow of refrigerant to one or more evaporators. The system includes a first refrigerant fluid flow loop leading from an output of the compressor and ultimately back into an inlet of the compressor and comprising a first fluid line leading from the compressor's outlet through a condenser, through a throttling valve, through an evaporator and back to the inlet of the compressor.

A second fluid flow loop may be provided to lead from the compressor's outlet directly through the evaporator and back to the compressor's inlet and comprises a second fluid line leading from the first line, just downstream of the compressor, through a hot gas flow valve and back into the first line at a first point downstream of the throttling valve and upstream of the evaporator.

A third fluid flow loop of the system may be provided to lead from the compressor's outlet through the condenser and then directly back to the compressor's inlet, and includes a third fluid line leading from the first line, at a point downstsream of the condenser and upstream of the throttling valve, through a compressor-protecting expansion valve and back into the first line at a second point downstream of the evaporator and upstream of the compressor.

All of the valves in the system comprise smoothly varaiable, flow valves controllable in response to temperatures sensed appropriately throughout the system in order to open and close to an extent demanded.

In order to provide refrigerant flow control throughout the system, it includes a control subsystem responsive to temperature sensors downstream of one or more of the proportional-flow valves and at the fluid body or bodies to be chilled, for operating controllers regulating the one or more throttling and bypass proportional-flow valves in a manner causing coolanat fluid to flow substantially exclusively through the first loop under normal conditions wherein cooling is required in the body of the fluid; for regulating inlet pressure to the compressor within preselected limits, through bypassing coolant; for causing at least some of the hot coolant gas from the compressor to flow through the second loop when a temperature set point is approached or when warming is required in the body of fluid; and for causing at least some of the coolant fluid in the first line to bypass through the third loop when the temperature of fluid entering the compressor becomes so high as to approach the temperature limit and thereby endanger the gas-cooled motor driving the compressor.

The system of the invention thereby operates to maintain the body of fluid substantially at a selected temperature in both hot and cold ambient temperatures through the first and second flow loops. However, if the ambient temperature becomes too high for the compressor's range of operation, the flow of refrigerant is reduced through the evaporator in order to protect the compressor, in which case cooling of the body of fluid is deliberately limited, protection of the compressor against overload being given a higher system operating priority than the chilling operations.

In another principal embodiment of the invention, there are again preferably three separate refrigerant flow loops: a main flow loop including a throttling valve for the liquid-gas refrigerant; a bypass loop for bypassing liquid refrigerant downstream of the condenser when the temperature in a body of fluid to be cooled approaches a desired set point, thereby reducing the applied cooling and reducing the work of the compressor, while keeping it operating; and a third loop comprising a compressor-protecting bypass flow loop for injecting expanding liquid/gas refrigerant into the compressor return line when the temperature of return refrigerant gas to the compressor approaches an operating limit for the compressor. The compressor must be protected, because it comprises a hermetic or semi-hermetically-sealed compressor wherein some of its heat dissipation is provided by transfer to refrigerant gas being compressed therein and flowing therethrough.

The systems of the invention are operated with the compressor continuously operating, and with proportional-flow valves which do not cycle stress through the system. All of the temperature sensors are scanned or polled repeatedly during system operation to determine the valve then having the maximum flow rate. Temperature is then measured at the valve or valves sensed as having maximum flow rate, thereby enabling constant monitoring of downstream temperature, where liquid and vapor are always present, regardless of operating mode. Pressure between the throttling valve and the compressor inlet can then be ascertained from this measured temperature in accordance with a known temperature/pressure relationship for the refrigerant being used.

All of the valves open or close to an extent proportional to the demand or lack of demand for cooling or compressor protection. There is no sudden opening or closing of any valve, i.e., no step-functioned operation in the system The result is that the systems embodying the invention have extremely long life in comparison with prior art continuous-compressor bypass systems which have utilized diaphragm valves and solenoid valves. In contrast, prior systems have required numerous valve openings and closings in order to maintain load set point temperatures, except when cooling rate exactly meets the load condition or when overload conditions are present.

The system of the invention provides, as a secondary advantage, for operation of a vapor-compression refrigeration system under extremely high ambient temperatures where ordinary mechanical refrigeration will fail due to overheating. The system simply limits its cooling capacity under such conditions, continuing to cool at a reduced mode while protecting the compressor component of the system against overheating and failure. For example, in refrigerated trucks traveling in hot conditions such as across deserts, the very high ambient temperature ordinarily will prevent many conventional mechanical refrigeration systems from operating. In a specific embodiment of this additional advanatage, a temperature sensor located downstream of the receiver, filter, drier, and sight glass senses condensation temperature of the refrigerant vapor. If the temperature is too high at this location in the system, the temperature controller on a priority basis optionally may reduce flow of refrigerant through the throttling valve to the evaporator, thereby reducing system cooling capacity.

These and other objects, advantages, features and characteristics of the invention will be more readily understood and appreciated from the following description of several preferred emodiments of the invention presented in conjunction with the accompanying drawings.

DESCRIPTION OF PREFERRED EMBODIMENTS

Figure 1:
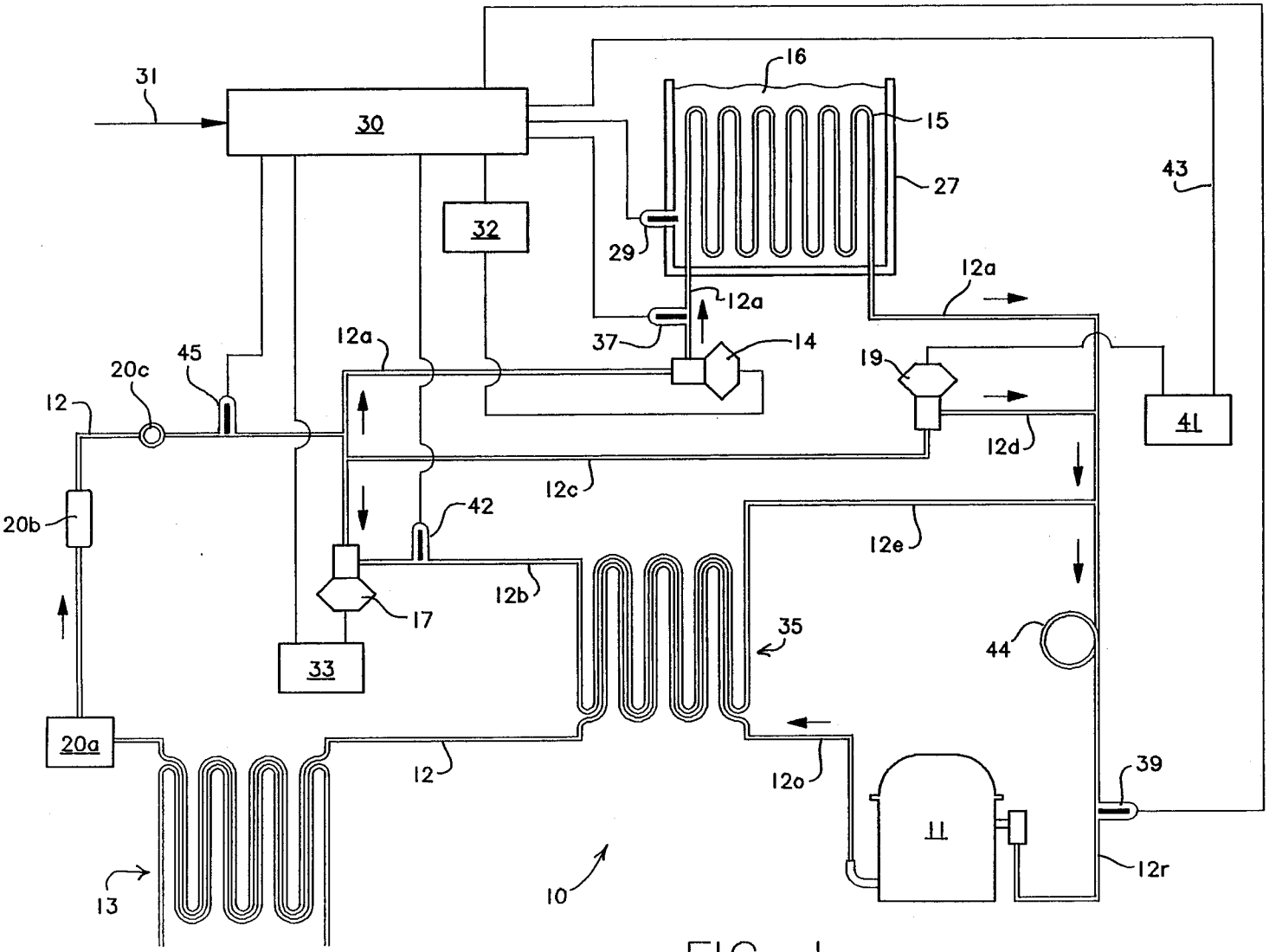
FIG. 1 is a schematic diagram of single cooling channel refrigeration system in accordance with the principles of the present invention.

In the drawings, FIG. 1 shows a first refrigeration system according to the invention, generally represented by the reference number 10. The system is a vapor-compression refrigeration system utilizing a standard liquid-gas coolant such as Freon. Principal components of the system are a compressor unit 11, which is continuously operating, a main coolant line 12 in a first flow loop, a water or air cooled condenser 13 (a water cooled condenser 13 is depicted in FIG. 1 by way of example only), a proportional flow throttling valve 14, leading to an evaporator coil 15 in a body of fluid 16 to be cooled, and additional valves, bypass flow loops and temperature sensors and controls, to be described hereinafter. The evaporator coil 15 could be in an air conditioning duct, and a temperature sensor 29 could be used to control room temperature by sensing temperature in the body of air to be controlled. Sensed temperature at the sensor 29 would then be processed in an analog or digital controller 30 which thereupon regulates operation of the throttling valve 14 by commanding proportional opening thereof through a valve controller 32. As suggested by FIG. 1, the evaporator coil 15 is disposed in a chilling tank 27 containing a liquid 16 to be chilled to a preset temperature entered into the controller 30, over a control signal path 31.

The main coolant line 12 branches into a plurality of fluid flow loops. A first fluid flow loop **12*a* of the system 10 extends through the throttling valve 14 and the evaporator coil 15. The main line 12 branches at a first bypass valve 17 which is provided for bypassing refrigerant through a second fluid flow loop including a fluid line 12*b*. The main line 12 further branches and leads over a line 12*c* to a second bypass valve 19 for bypassing coolant through another bypass flow loop or third fluid flow loop including a fluid line 12*d***. This third fluid flow loop provides one of the features of the present invention related to control of compressor temperature. It should be understood that a properly sized and designed system incorporating the principles of the present invention will operate over a substantial temperature range without requiring this third loop.

The system 10 may also include several components which are conventional and/or optional in prior art systems and need not be described here. For example, a liquid receiver **20*a*, a filter/drier 20*b*, as a sight glass 20*c* may be included in the main loop line 12**.

The compressor unit 11 of the system 10 is kept operating continuously, at least for a period of operation of the equipment or other facility served by the body of fluid 16 to be cooled, such as a day, a week, etc. This avoids any on/off cycling of the compressor unit 11 and greatly adds to the compressor's life. The compressor unit 11 is of the type which are cooled partially by heat transfer to the refrigerant fluid passing through it, i.e., by the return gas which is then compressed and heated by the compressor, and it has a specific upper limit of permissible inlet gas temperature which cannot be exceeded for safe operation of the compressor. Similarly, the compressor must operate within certain pressure differentials. The differential pressure between the high-pressure outlet gas in the outflow line **12*o* just downstream of the compressor unit 11 and the inlet gas in a return line portion 12*r* just upstream of the compressor unit 11** must not exceed a certain limit differential.

The body of fluid 16 to be cooled, which may be air or other gas in a space to be cooled, or liquid such as indicated in FIG. 1 retained in the liquid reservoir 27, or any other body to be cooled by the coil 15, is monitored as to temperature by the temperature sensor 29, leading to the controller 30 which has provision for setting a desired set point temperature for the fluid body over the control signal path 31, as already explained. In general, when the differential between the actual temperature of the body sensed by the sensor 29 and the desired temperature set point ata the controller 30 is great, and full-capacity cooling is needed, coolant fluid travels from the compressor unit 11 through the first or main loop comprising the fluid line **12*o*, from the compressor 11, through the condenser 13 and the other components 20*a*, 20*b*, 20*c*, through the throttling valve 14, through the evaporator coil 15 in the body of fluid 16, and back to the compressor unit 11, through the return line portion 12*r***.

However, when the temperature of the fluid body 16 approaches the set point, as determined by the sensor 29 and the controller 30, the system 10 automatically reduces cooling at the evaporator coil 15 and starts to bypass coolant around the throttling valve 14 and the evaporator coil 15, through the second fluid flow loop (or first bypass loop) including the line **12*b* and valve 17. This bypassing preferably starts at a predetermined temperature spread away from the set point, e.g., if the set point were 20°, the bypassing might begin on a proportional basis when the temperature of the fluid body 16 has been reduced to 22°. If the maximum temperature limit of the compressor unit 11 is being reached, then bypass flow automatically begins through the third fluid flow loop (or second bypass loop) including the line 12***c*, valve 19 and line 12*d*.

All proportional bypassing of coolant fluid is thus accomplished by operation of the valves 14, 17 and 19. All of these valves are proportional-flow valves as discussed above, opening only in proportion to demand requirements, and thereby effecting an adjustable balance between the three flow loops. This avoids the cycling of stress through the valves and throughout the system 10 as discussed earlier, and also enables a set point to be achieved very closely and maintained closely.

When the set point is approached, i.e., a limit temperature spread is reached as described, the temperature controller 30 sends a signal to the valve controller 32 to begin proportionally closing down the throttling valve 14, and at the same time the controller 30 may send a signal to a bypass controllere 33 to begin proportionally opening the first bypass valve 17, to admit warm liquid refrigerant into the first bypass line 12*b*. It is to be understood that for a portion of the range of operation of the system 10, the step of throttling back the throttling valve 14 will be sufficient and appropriate to control cooling of the body of fluid 16. This range may be from e.g. 100% cooling to about 50% cooling capacity. At about 50%, the first bypass valve 17 may come into operation.

Since the compressor unit 11 can never be permitted to receive an incompressible refrigerant in liquid state, there is included in this first bypass loop a heat exchanger 35 for transferring to the bypassed refrigerant some of the heat from the hot gas leaving the compressor unit 11 and thereby converting the liquid refrigerant in the first bypass line 12*b* into a gaseous state. The refrigerant leaving the bypass heat exchanger 35 on a line 12*e* as warm gas, is returned to the return line 12*r* leading to the compressor inlet. Additionally, the liquid refrigerant passing through the bypass valve 17 and into the bypass line 12*b* undergoes some conversion to vapor state as it first enters the line 12*b*, simply because of the pressure drop encountered at that point.

The effect of this controlled bypassing of refrigerant over the first bypass loop (including lines 12*b* and 12*e* and bypass heat exchanger 35) is (1): to limit the lowest pressure in the suction line 12*r* at which the compressor unit 11 is permitted to operate; and, (2): to limit the lowest temperature that will be reached by the evaporator 15. These limits prevent the fluid body 16 from freezing onto the evaporator coils 15.

As the fluid body 16 continues to approach the set point, albeit more slowly, the valve 14 is commanded proportionally to close further and the bypass valve 17 is commanded proportionally to open further, approaching a situation of full bypass. The increased flow through the bypass line 12*b* reduces the back pressure from the compressor unit 11 in the line 12*o*, thereby decreasing the work of the compressor. The compressor unit 11 continues to operate under a reduced load, and could reach an almost no load condition when the set point is reached by the sensor 29.

At the set point temperature, a temperature sensor 42 in the first bypass path 12*b* immediately downstream of the bypass valve 17 will be scanned, along with the other sensors in the system 10. Since most, if not all of the refrigerant, is now flowing over the first bypass loop lines 12*b*, 12*e*, the sensor 42 will probably be selectd as indicative of pressure in the overall flow path 12. As both liquid refrigerant and flash gas are present at the location of the selected sensor 42 in the refrigeration circuit, pressure in the line 12 in this area can always be determined from the temperature, since there is a fixed relationship between temperature and pressure in a line of coolant where both liquid and flash gas are present. Therefore, pressure in the line 12 downstream of the throttling valve 14 can be monitored via temperature at the selected refrigerant sensor. Temperature in the entire portion of the line 12 between the throttling valve 14 and the return line 12*r* to the compressor unit 11, is substantially the same, so that a monitoring of temperature at the selected sensor will effectively give an indication of pressure in the line 12 just upstream of the compressor unit 11.

This pressure monitoring is important, since the compressor unit 11 must operate within limits of pressure at the suction port line 12*r*, as discussed above. If the temperature at the selected refrigerant sensor indicates that pressure in the final return line portion 12*r* has dropped too low, or approaches dropping too low, entering a preset pressure spread, this indicates a danger to the compressor unit 11 from thermal overloading. The system 10 therefore corrects the situation, again by bypassing fluid. Fluid is bypassed on a proportional basis through the first bypass loop or second fluid flow loop through the valve 17 and through the line 12*b*, restoring pressure in the return line portion 12*r* to the appropriate level, within the design limits of the compressor unit 11. As soon as the pressure rises to an acceptable level, this is sensed via temperature at a selected refrigerant temperature sensor. The proportional bypassing can then be continued. Bypassing and the removal of bypassing are always effected proportionally by the valves and controllers of systems incorporating the present invention.

Another condition involving the design limits of the compressor unit 11 will also cause the system 10 to bypass coolant fluid around the throttling valve 14 and the evaporator 15. If the system 10 is under a high ambient, operation in such condition will pose an overheating threat to the compressor unit 11. Liquid leaving the condensor coil 13 through the line 12 will tend to become hotter and hotter under these conditions, approaching a situation wherein the designed temperature limit of the compressor unit 11 will be exceeded due to excessive back pressure in the condensor coil. The compressor unit 11 is partially cooled only by suction gas, and the design limits must not be exceeded in order to maintain safe operation.

In this situation, the valve 14 feeding freon to the evaporator coil 15 will be reduced on a proportional basis. Thus, is the temperature of liquid in the main line portion 12, as sensed at a sensor 45 located in the line 12, becomes, for example, within about 10° or 5° of the upper limit of permissible temperature, flow reduction will begin to be effected on a proportional basis. Under the conditions described, when the compressor-protecting bypass is effected through the valve 19, heat removal from the body of fluid 16 will be reduced. The heat removal rate may be limited below the level required to maintain the body of fluid 16 at a desired temperature, or to continue to approach that desired temperature. However, the need to protect the compressor unit 11 is deemed to be paramount to the operation of the system 10, and cooling of the fluid 16 is in this sense secondary. This prioritization thereby enables systems of the present invention to be used under conditions wherein very high thermal ambients may be successfully encountered, while many prior art vapor-compression systems will fail under the same high ambient conditions.

At the same time the valve 19 may be commanded via a valve controller 41 under the control of the temperature controller 30 to begin to open, and the throttling valve 14 is commanded to close down as the temperature at the sensor 39 becomes within a preselected range approaching the upper operating limit of the compressor unit 11.

As the valve 19 opens, it acts as a throttling valve and converts pressurized liquid to vapor and flash gas in a downstream end portion **12*d* of the bypass line 12*c*. This vapor and flash gas enters the main loop line 12*r* at the point indicated, where it meets much hotter gas (which would have threatened the compressor), where the conversion to gas is completed by the mixing of the fluids. Preferably, a bend or loop 44 is included in the return line 12*r* to assure that the conversion to gas will be complete before it reaches the compressor inlet. Since very few BTU's are required to drop the temperature of the suction gas considerably, a small refrigerant flow can cool a fairly large hot gas suction stream. Thus, the valve 19 may be made considerably smaller than the throttling valve 14. For example, if the throttling valve were two tons capacity (24,000 BTU), the hot gas bypass valve 19** might be ⅓ to ½ ton capacity (4000–6000 BTU).

The effect of the bypass provided by the valve 19 is to lower the temperature of suction gas in the final return portion **12*r* of the line 12**, keeping the compressor temperature within safe operating limits.

The effect is also to raise pressure in the line 12 downstream of the throttling valve 14 and upstream of the compressor 11. Since the pressure throughout this region of the line 12 is substantially the same, the pressure in the line portion **12*r* is essentially the same as at the temperature sensor 37 upstream of the evaporator 15. This pressure is therefore directly related to the temperature read at the sensor 37, and this information is fed to the controller 30. The controller 30 accordingly knows that pressure has increased in the final line portion 12*r*, and with this information it determines to proportionally throttle down the throttle valve 14 to reduce flow through the evaporator coil 15**.

The connection 43 is included between the compressorprotecting controller 41 and the set point temperature controller 30. In this way, a signal can be sent from the controller 30 whenever it determines on the basis of the temperature sensed at the sensor 39 that refrigerant gas bypass is necessary through the line **12*c* the valve 19 and the line 12*d* in order to protect the compressor by reducing suction return gas temperature. This information is then fed via the controller 32 to the throttling valve 14, to reduce its open position accordingly. The temperature of suction gas in the return line portion 12*r* will be reduced, and the temperature of the compressor unit 11** will be adequately controlled and kept within its thermal operating limits.

It should be understood that temperature sensors are provided throughout the refrigeration path of the system 10 in a manner which will provide useful control information. For example, a sensor 45 may be provided in the main flow path 12 between the sight glass **20*c* and the three way flow branch leading to the three flow loops. The temperature sensors in the system 10 are each rad about once per second in a scan sequence by the controller 30. This information can be used to sense an overload situation. For example, in an air cooled condensor system, it the ambient air temperture becomes too high to permit the system to provide full cooling capacity without endangering the compressor unit 11, the controller 30 may reduce flow of coolant through the throttling valve 14** in order to limit system cooling capacity to a safe level.

Figure 2:
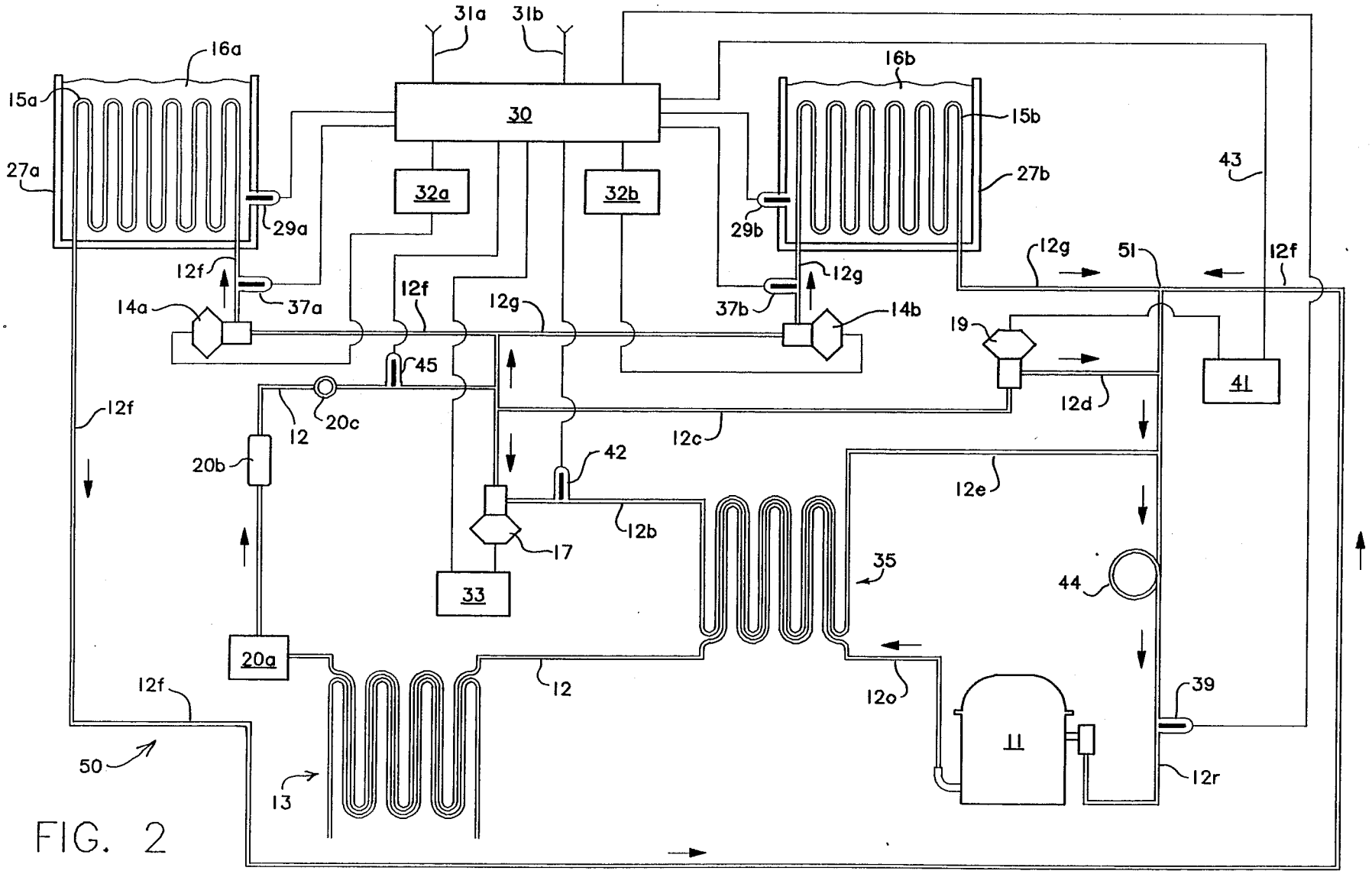
FIG. 2 is a system similar to that of FIG. 1, but including dual cooling channels for independently cooling two separate and independent bodies of fluids using one cooling system.

FIG. 2 shows a dual channel refrigeration system, similar to the system shown in FIG. 1 but including multiple reservoirs as exemplified by the two separate reservoirs **27*a* and 27*b* in FIG. 2. Each reservoir includes a different body of fluid 16*a* and 16*b*** to be cooled.

Most of the features of the dual channel system 50 shown in FIG. 2 are similar to those of the system 10 of FIG. 1, and so the same reference numerals are used with the same structural elements. Where the elements are duplicated, because of the two channels, the same reference number is employed, with alphabetic suffixes to indicate the duality. In the dual channel system 50, when the coolant in the main flow line 12 approaches the tanks **27*a* and 27*b*, it is divided into four branch flow lines: two main path flow lines 12*f* and 12*g*, and the two bypass lines 12*b* and 12*c* already explained in association with the FIG. 1 system 10**.

The branch line **12*f* approaches a throttling valve 14*a* and evaporator coil 15*a* disposed in a cooling tank 27*a* for cooling a body of e.g. liquid 16*a*, while the branch line 12*g* leads to a throttling valve 14*b* and an evaporator 15*b* disposed in a cooling tank 27*b* for cooling a second body of e.g. liquid 16*b*. Downstream of each evaporator 15*a* and 15*b*, return portions of the lines 12*f* and 12*g* meet again at a junction 51 and merge into the common return line 12*r* and flow therethrough to the suction (inlet) side of the compressor unit 11, as occurred in the system 10 of FIG. 1**.

The bodies of fluid **16*a* and 16*b* of the tanks 27*a* and 27*b* may be at different temperatures, and in some applications are likely to be at greatly differeing temperatures, as sensed by the temperature sensors 29*a* and 29*b*. The system 50 of the invention includes provision for opening the valves 14*a* and 14*b* to different degrees, depending upon demand requirements in the different channels represented by actual sensed temperatures of the bodies 16*a* and 16*b* of fluid in comparison with set points entered on paths 31*a* and 31*b*. For example, if demand is or suddenly becomes very high at the tank 27*a*, the valve 14*a* might be nearly fully open while the valve 14*b* is nearly closed, such that 90% of the fluid flow is now through the valve 14*a* and only 10% is presently through the valve 14*b*. Since most of the cooling capacity is applied to the body 16*a*, the temperature thereof will probably rach the set point before the temperature of the body 16*b*. Once the body 16*a* reaches set point, then the valve 14*a* is throttled back and substantially greater cooling capacity is applied to the body 16*b* until it too reaches its set point temperature. The system 50** will not attempt to achieve maximum cooling at both tanks simultaneously, in the situation where demand is great at both.

To control the cooling rate at each tank **27*a* and 27*b*, the set point controller 30 receives set point tempertures over the paths 31*a* and 31*b* and receives actual sensed temperature information from sensors 29*a* and 29*b* in the tanks and thereupon operates the throttle valve controllers 32*a* and 32*b* in order to control operation of the throttle valves 14*a* and 14*b*. Based on the error between the set point temperatures and the sensed temperatures, i.e. the demand level at each reservoir 27a and 27b, the controller 30 will weight, on a proportioning basis, the amount of opening signal that goes to each throttling valve 14a and 14b**.

Figure 3:
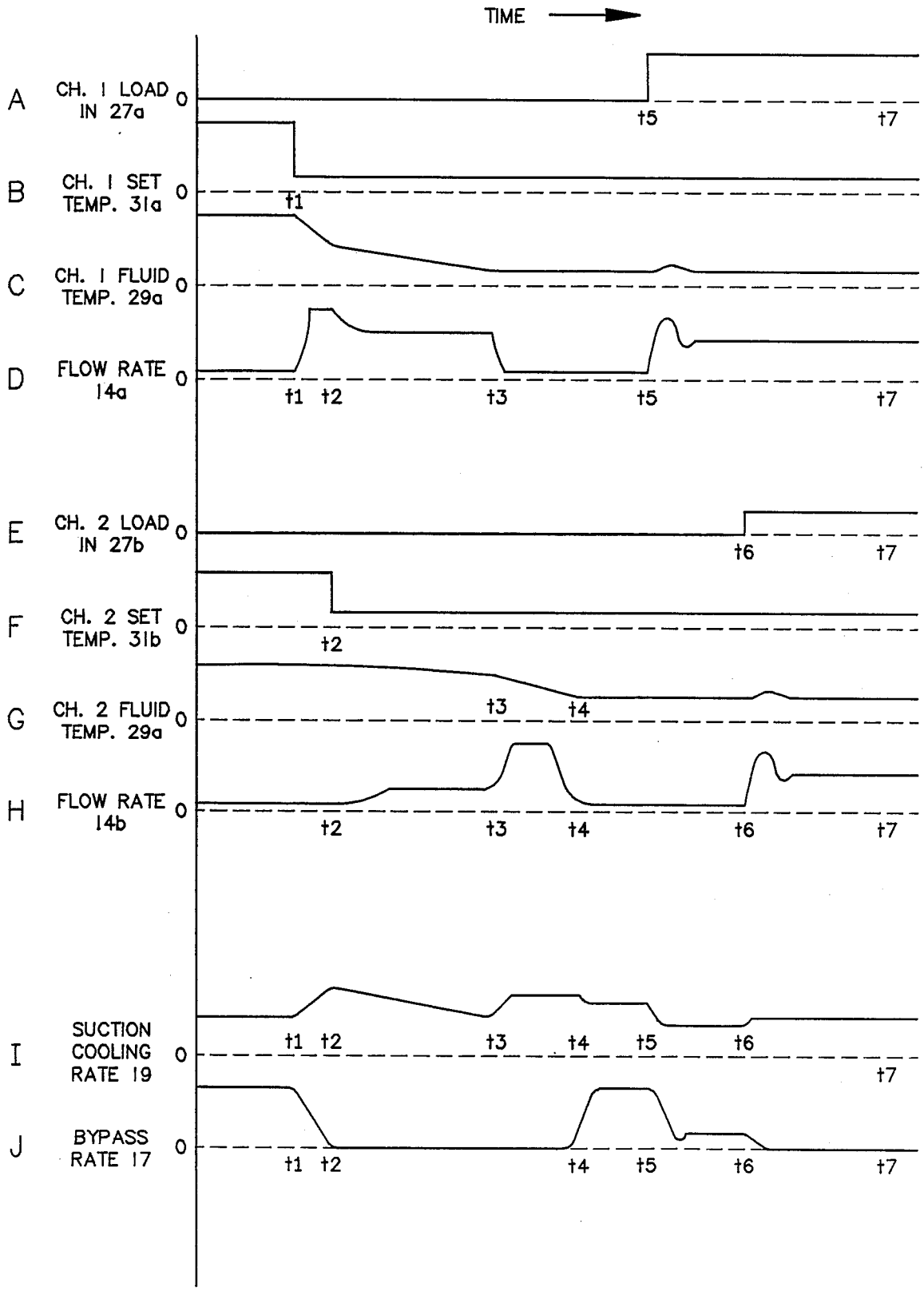
FIG. 3 is a graph showing operation of a dual channel cooling system, such as the system depicted in and described in conjunction with FIG. 2.

Operation of the dual channel system 50 may be better understood by reference to FIG. 3 which is a series of graphs of values plotted against a common horizontal time base. Graphs A-D relate to operation in "channel 1" which includes the flow path 12f, valve 14a, evaporator coil 15a, fluid body 16a in tank 27a, fluid body sensor 29a and refrigerant sensor 37a immediately downstream of the valve 14a. Graphs E-H relate to operation in "channel 2" which includes the flow path 12g, valve 14b, evaporator coil 15b, fluid body 16b in tank 27b, fluid body sensor 29b and refrigerant sensor 37b immediately downstream of the valve 14b. The graph J relates to operation of the first bypass loop including the valve 17, warm gas heat exchanger 35 and flow paths 12b and 12e; and the graph I relates to the second bypass loop including the valve 19 and the flow paths 12c and 12d.

At the earliest time shown on FIG. 3, time 0 (which is at the left edge of each graph), in channel 1 there is no load in the tank 27a, and there is a high temperature set point at the control path 31a. The temperature of the fluid body 16a as sensed by the sensor 29a matches the path 31a set point; and the flow rate of refrigerant commanded through the throttling valve 14a is virtually nil. In channel 2, there is no load in the tank 27b; the channel 2 set point temperature on the path 31b matches the temperature of the body 16b as sensed by the sensor 29b, and the channel 2 flow rate of refrigerant through the throttling valve 14b is also virtually nil. At the same time, the first bypass loop flow rate through the valve 17 is high (Graph J), and the suction cooling loop bypass flow rate through the valve 19 is also at a substantial value (Graph I).

At time t1 the set temperature in channel 1 is commanded to a lower temperature by a signal over the path 31a. Almost immediately the flow rate of refrigerant through the valve 14a increases dramatically, and quickly reaches a maximum value indicated by the flat portion of graph D between t1 and t2. At the same time the temperature of the body 16a in the tank 27a begins to fall as charted by graph C, but does not reach the new, lower set point temperature until approximately time t3, at which time the refrigerant flow through the valve 14a is throttled back to a minimum flow rate.

In the meanwhile, at time t2, the set point temperature for channel 2 is commanded to drop by virtue of a signal sent over the path 31b, and the flow rate through the valve 14b increases rather slowly, since channel 1 is requiring a maximum flow of refrigerant at time t2. Flow through the valve 14b reaches a constant value after time t2, and temperature of the body 16b falls ever so slightly during the interval following time t2. At time t2, since both channels are requiring cooling at a maximum rate, since channel 1 is taking the lion's share of cooling, with a slight amount of cooling being diverted to channel 2, there is no need for bypass, and the first bypass path through the valve 17 is turned off. However, since there is a peak load situation at time t2 there is an increase in suction cooling bypass through the valve 19 which immediately peaks and begins to fall off. As the temperature at the tank 27a begins to fall, there is less need for suction cooling.

As already mentioned, at time t3 the temperature of the fluid 16a in the channel 1 tank 27a reaches the set point, and the flow of freon through the first throttling valve 14a is cut off by the controller 30 as depicted in graph D. This immediately makes full cooling capacity available to the second channel, and the flow rate through the valve 14b increases rapidly to a maximum value which continues until time t4 when fluid temperature in the body 16b equals the new channel 2 set point temperature and the valve 14b is closed down to minimal flow rate. During the time interval from t3 to t4, the system 50 works at maximum cooling capacity, and some increased amount of suction cooling bypass flow is required through the second bypass loop and valve 19 as depicted in graph I. At the time t4, since both fluid bodies 16a and 16b are at their respective set point temperatures, the first bypass loop valve 17 is opened and rapidly achieves a maximum flow rate as depicted in graph J.

At time t5 the channel 1 load in the tank 27a increases as indicated by the step in graph A and the slight bump in fluid temperature in graph C. The valve 14a is opened to full flow but is quickly throttled back to a fractional flow rate as the fluid body 16a returns to the set point. At time t5 both bypass loops are throttled back, the first loop through the valve 17 being reduced almost to no bypass flow, and the suction cooling bypass flow through the valve 19 to a lesser flow rate. These settings and rates stabilize and remain constant until time t6.

At time t6 the load increases in the channel 2 tank 27b at which time the valve 14b is opened part way and a fractional flow therethrough peaks and then stabilizes at a fractional rate depicted in graph H. Since refrigerant is now flowing through valve 14a in channel 1 at about two thirds of maximum flow rate, and about one third of maximum flow rate is also flowing through the valve 14b in channel 2, there is no need for bypass, and the valve 17 is cut off completely. Since the system 50 is working at maximum capacity, there is some slightly increased flow through the suction cooling bypass loop including valve 19.

As is apparent from the discussion of system 50 operation illustrated by FIG. 3, the first and second bypass loops, comprising fluid lines 12b and 12e, and lines 12c and 12d and associated bypass valves 17 and 19, function in substantially the same manner in the system 50 as in the single-channel system 10 described above.

Figure 4:
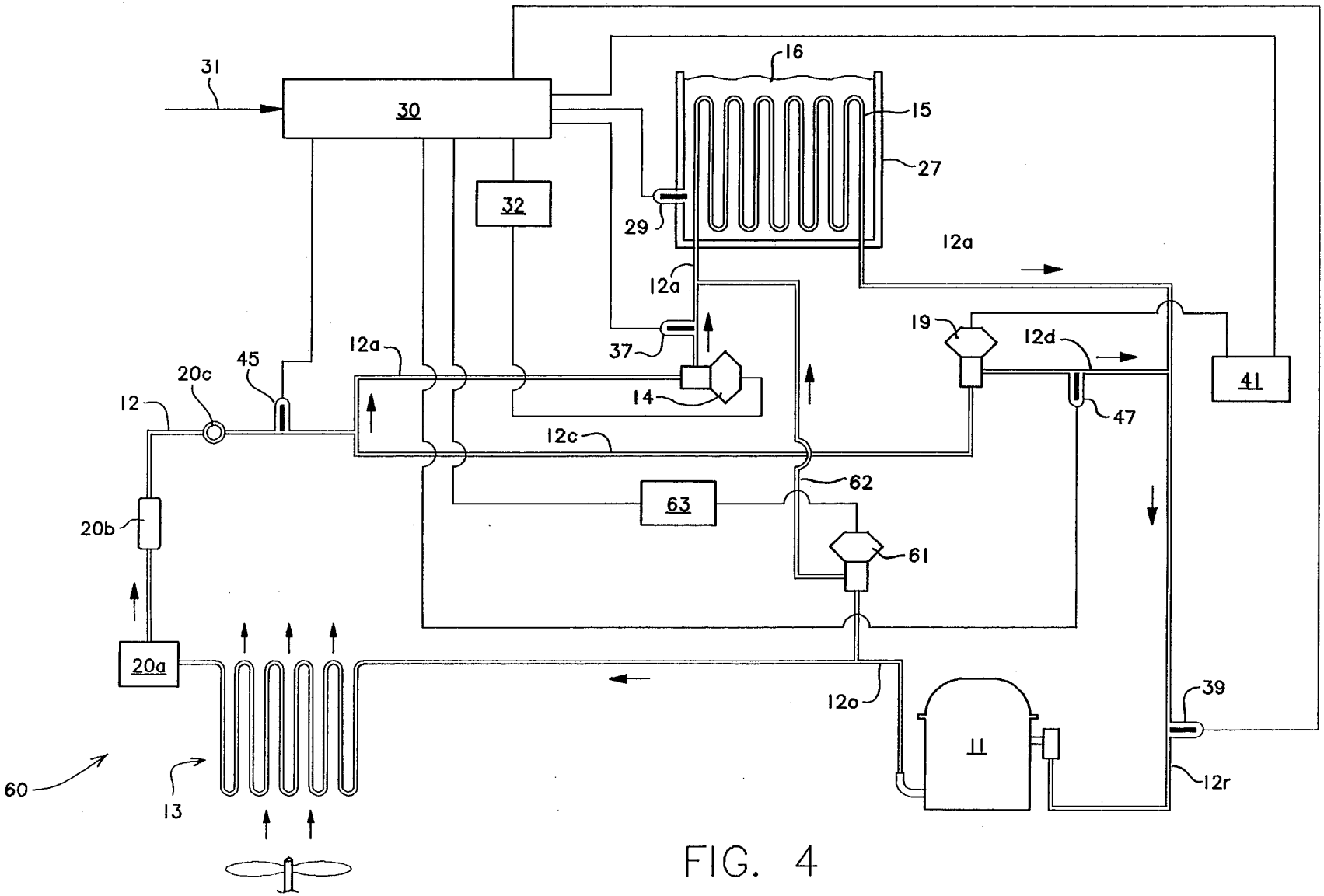
FIG. 4 is a schematic diagram showing a system according to the invention for controlling a body of fluid using both cooling and substantial heating derived from the same system components.

FIG. 4 shows a single-channel refrigeration system 60 according to the invention. This system utilizes most of the principles described in connection with the FIG. 1 system 10, but includes several important differences including heating of a body of fluid 16 using heat from the compressor 11 when heating of the body 16 rather than cooling thereof is demanded by the set point controller 30. In the other two systems 10 and 50, heating may also be included but preferably is provided by an outside heat source such as an electric resistor coil disposed in the tank 27 (or tanks 27a and 27b in the dual channel system 50).

The system 60 includes a compressor unit 11, a main line 12 including an outflow portion 12o downstream from the compressor unit 11 and an inlet return portion upstream of the compressor unit 11 at its suction inlet, an air cooled condenser 13, a throttling valve 14, an evaporator 15 within a body of fluid 16 to be heated or cooled, and a compressorprotecting valve 19 and associated bypass lines 12c and 12d (in a third fluid flow loop), similar to those described with reference to the system 10 of FIG. 1. A main or first fluid flow loop is defined through the fluid line 12, which under maximum demand conditions normally conducts cooling fluid from the compressor 11 through the condenser 13 and through the throttling valve 14 and the evaporator 15 to return it as hot suction gas to the inlet side of the compressor unit 11 as above. The condenser 13 may be air-cooled or water cooled.

However, the system 60 includes another bypass flow loop or second fluid flow loop, comprising a hot gas bypass valve 61 and a hot gas flow line 62, which differs in some respects from the apparatus, method and systems 10 and 50 described above.

Figure 9:
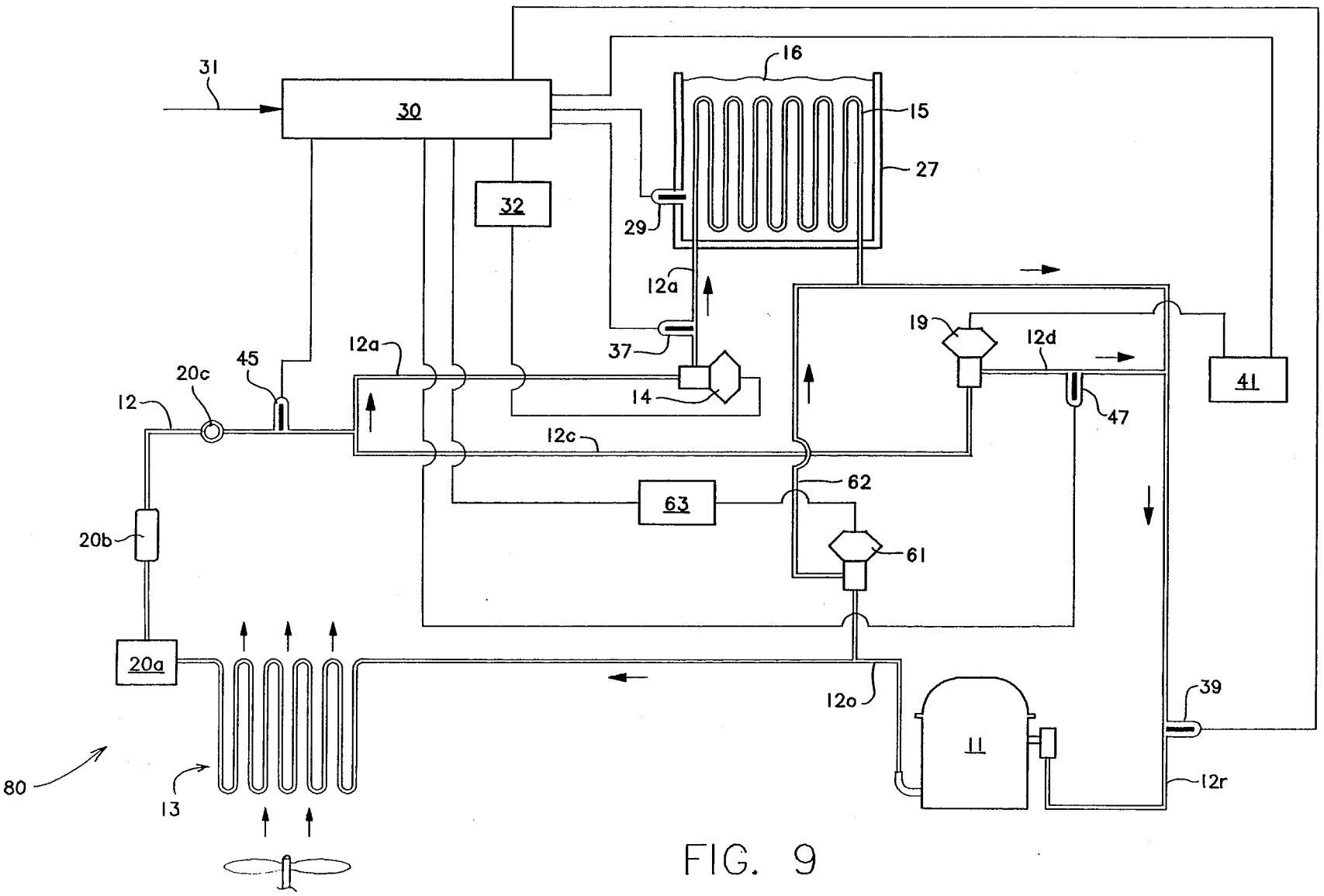
FIG. 9 is a schematic diagram of a single cooling channel refrigeration system in accordance with the principles of the present invention in which a proportional flow gas valve is employed for controlled direct bypass of hot gas around the evaporator.

In the system 60, the bypass line 62 of the second flow loop leads via the valve 61 directly to the inlet side of the evaporator coil 15, just downstream of the temperature sensor 37. (It could also lead directly to the output side of the evaporator coil 15 in a system 80 as depicted in FIG. 9. Compressor heating of the water 16 would not take place in the system 80 depicted in FIG. 9.) The function of this bypass loop, is in part similar to the function of the second flow loop (valve 17 and lines **12*b* and 12*e*) of the FIG. 1 system, in balancing flows as a set point is approached and in proportioning flows through the first and second loops to maintain a set point temperature. However, the function of this bypass loop in the system 60 is also to heat the body of fluid 16 when heat is demanded, as determined by a tank temperature sensor 29 and a controller 30 at which the desired temperature is set. Since hot gas on the outflow line 12*o* passes directly through the bypass valve 61, it is necessary that this valve be a gas valve which is able to withstand the temperature range of the hot gas exiting the compressor unit 11** while still providing controllable modulation of gas flow over the bypass loop.

The system 60 operates for the most part similarly to the system 10 of FIG. 1, in that, under normal conditions of high cooling demand in the body of fluid 16, and when the operating conditions are well within the limits of pressure and temperature of the compressor unit 11, coolant gas is compressed and heated by the compressor unit 11 and travels as hot gas through the main line 12, and through the condenser 13 where it is condensed to liquid. The liquid then approaches the throttling valve 14, through which it passes, expanding into the evaporator coil 15. Its temperature is sensed at the sensor 37, where both liquid and flash gas are present, and again this indicates pressure in the entire line from the sensor 37 down through the final return portion **12*r* of the line 12** leading to the compressor's suction inlet.

When ambient conditions, or conditions otherwise occurring in the body of fluid 16, add heat to the cooling fluid and the coil 15 to such an extent that the compressor unit 11 is threatened by too-high temperature suction gas, this condition is sensed by the temperature sensor 39 in the return line portion **12*r*. The information is fed to the controller 30 as above, which causes the compressor-protecting valve 19 to open to a proportional degree depending upon proximity to the limit temperature of the compressor unit 11**.

When the temperature of the body of fluid 16 in the tank 27 approaches the set point temperature selected on the controller 30, the associated valve controller 32 throttles down the throttling valve 14 for less flow through the evaporator coil 15 and a lower heat-removal rate, and the system 60 begins to bypass hot gas directly from the compressor through the valve 61 and the line 62. The components bypassed in this case are the condenser 13 and the throttling valve 14. The resulting warm to hot gas then passes through the evaorator coil 15 and returns to the compressor. The effect of the opening of the valve 61 is to maintain pressure downstream of the throttling valve 14 and to reduce back pressure at the outlet of the compressor unit 11, so that less work is donw by the compressor unit 11 and so that the heating of the refrigerant in the compressor unit 11 is substantially reduced.

Thus, proportional bypassing through the hot gas bypass valve 61, in balance with the throttling valve 14, occurs as the temperature set point is reached.

As indicated in FIG. 4, the hot gas bypass valve 61 is controlled by the controller 30. In this way, suction gas temperature monitored at the sensor 39 just upstream of the compressor unit 11 can be correlated with the temperature at the sensor 37 just downstream of the throttling valve, and the controller 30 can maintain a constant degree of superheat, i.e., a constant amount of temperature spread between the sensor 39 and the sensor 37. By way of further explanation, a temperature spread between the sensors 39 and 37 is required to be sure that liquid refrigerant never enters the compressor unit 11 as might occur if the temperatures were the same.

When the body of fluid 16 approaches the set point during warming, the position of the valves 61 and 14 is proportionately changed, until a balance is reached as discussed above with respect to the cooling of the body 16.

If hot gas is being bypassed through the valve 61, and there is very little if any flow of condensed refrigerant through the throttling valve 14, it is possible that some flow will be required through the suction flow bypass loop including valve 19 in order to keep suction gas below the thermal limit of the compressor unit 11. The pressure downstream of the valve 19 must be determined in order to be sure that a sufficient flow is passing through the valve 19, and for this reason, a temperature sensor 47 is provided in the flow line **12*d* immediately downstream of the valve 19**.

As mentioned above, the system 60 is also effective to heat the body of fluid 16 when required, such as in equipment wherein the temperature is too low in an initial start-up period. Again, this is determined by the sensor 29 and the set point controller 30, which sees a too-low temperature in the body 16 under this condition. It will then open the valve 61, keeping the valves 14 and 19 at maximum closure, to utilize heat of the continuously-operating compressor unit 11 to warm the body of fluid 16. Warming will be relatively gradual, since the compressor will be doing almost no work. The evaporator coil 15 in this situation becomes a heating coil for the fluid 16. It is thus apparent that the system 60 provides the same capability as is achieved by the system 10 with the additional charcteristics that heating may be applied to the fluid body from compressor heat and the third heat exchanger 35 may be eliminated. However, since the cost of the hot gas bypass valve 61 is presently quite high, its high cost tends to offset the savings from elimination of the exchanger 35.

Figure 5:
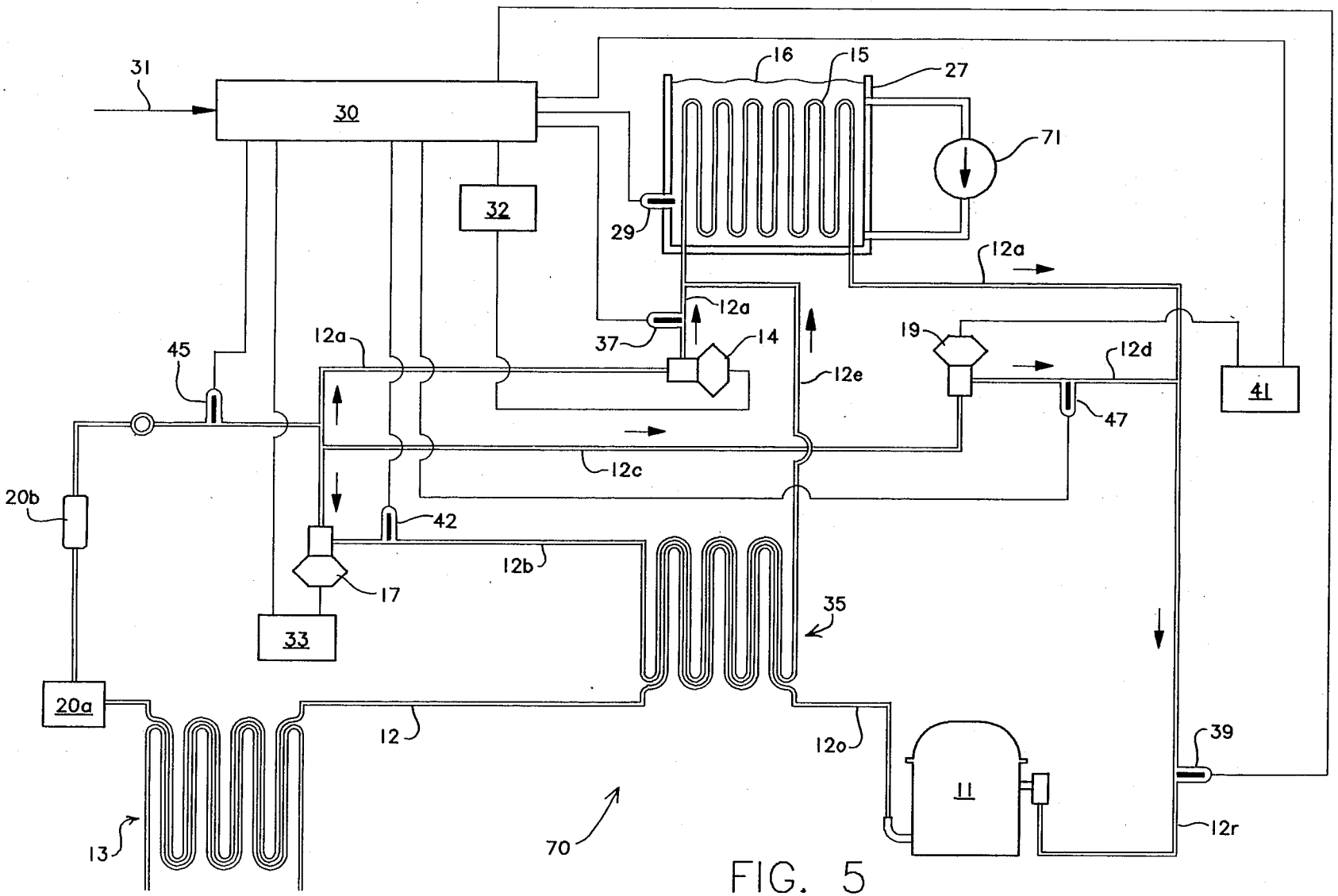
FIG. 5 is a schematic diagram showing a simple system according to the invention for controlling a body of fluid using both cooling and heating derived from the same system components with the range of heating capacity lower than that achieved by the FIG. 4 system.

One more preferred embodiment of the present invention is depicted in FIG. 5. This system 70 is quite similar to the system 10 except for the fact that the warmed gas bypass line 12e leading from the heat exchanger 35 is connected downstream of the throttling valve 14 so that heat from the compressor may be applied directly to the fluid body 16. This system 70 enables warm gas from the heat exchanger 35 to be circulated through the evaporator coil 15 in order to raise the temperature of the body 16 to a temperature in a normal or above ambient range. It is apparent by inspection of the system 70 that it is not possible to add heat to the body 16 at a temperature above the warm gas temperature present in the line 12*e*. This system 70 is particularly well suited for controlling intermittant processes such as industrial lasers which require that optical table environments be maintained at a precisely constant temperature at or above ambient temperature. In FIG. 5 a pump 71 has been added, along with piping, in order to illustrate that the fluid body in the tank 27 is actually moved throughout the industrial process being cooled.

In this regard it is important to note that the pump 71 may add a considerable amount of heat to the fluid 16, and this added heat must be taken into account in sizing the system 70.

As is the case for the system 60, in the system 70 a temperature spread between the sensors 39 and 37 is required to be sure that liquid refrigerant never enters the compressor unit 11 as might occur if the temperature were the same.

Figure 6:
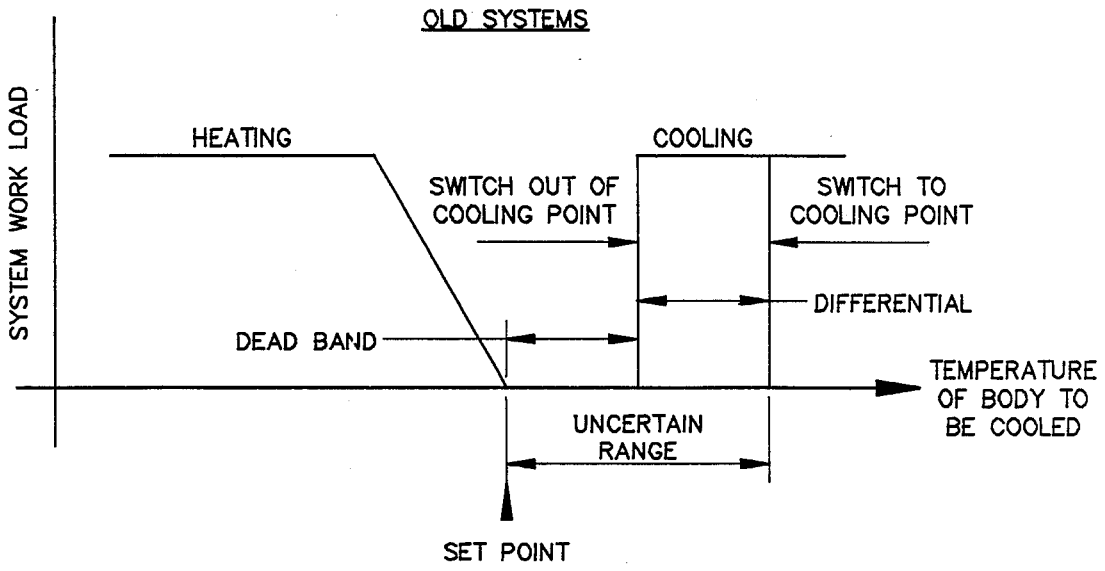
FIG. 6 PRIOR ART
FIG. 6 is a graph showing operation of a cycling heating/cooling system of the prior art, representing heating or cooling work performed by the system vs. temperature.
Figure 7:
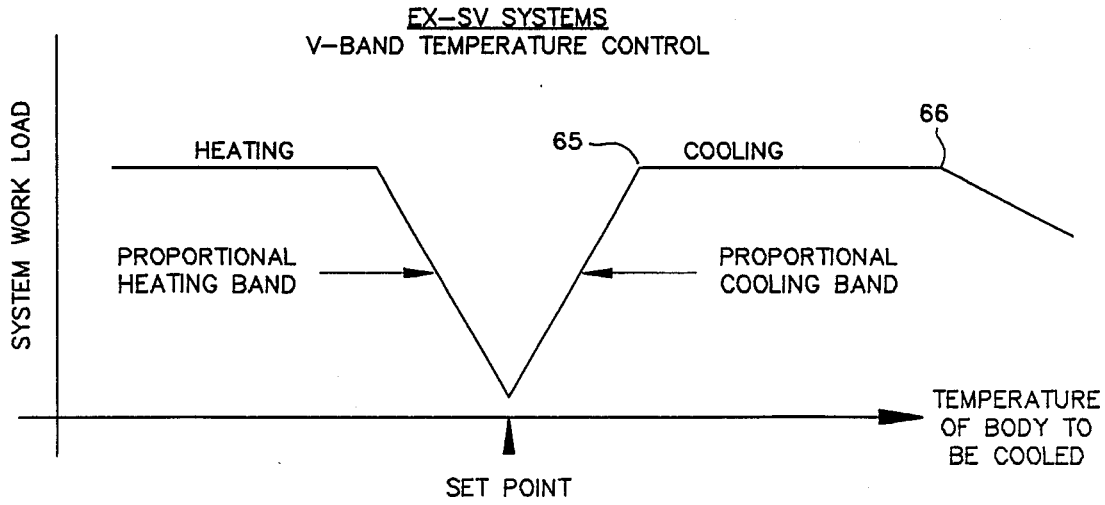
FIG. 7 is a graph similar to FIG. 6, but representing systems according to the invention.

FIGS. 6 through 8 make comparisons between prior art on/off cycling refrigeration systems, including prior art bypassing systems, and the systems of the invention.

In FIGS. 6 and 7, system work load is plotted against temperature of the body of fluid to be cooled, as to both heating and cooling functions. FIG. 6 shows that as the set point temperature is approached from the cold side, heating is proportionally diminished even in prior art systems. This is easily achieved with resistance heaters. However, as temperature continues to rise above the set point due to high ambient conditions, the system remains switched off (both heating and cooling) through a dead band of temperature as shown in the drawing. Finally, when temperature has risen to a predetermined level above the set point, full cooling is suddenly switched on, and remains on in full until the set point is reached.

FIG. 7 shows, in contrast, what happens under similar conditions with the systems of the invention. The approach to set point from the heating side is similar to FIG. 6, but once the set point is reached and temperature continues to rise, cooling is turned on proportionally, rising steadily in proportion to demand. Full cooling is reached, at a point 65 as indicated, only if temperature continues rising.

Figure 8A:
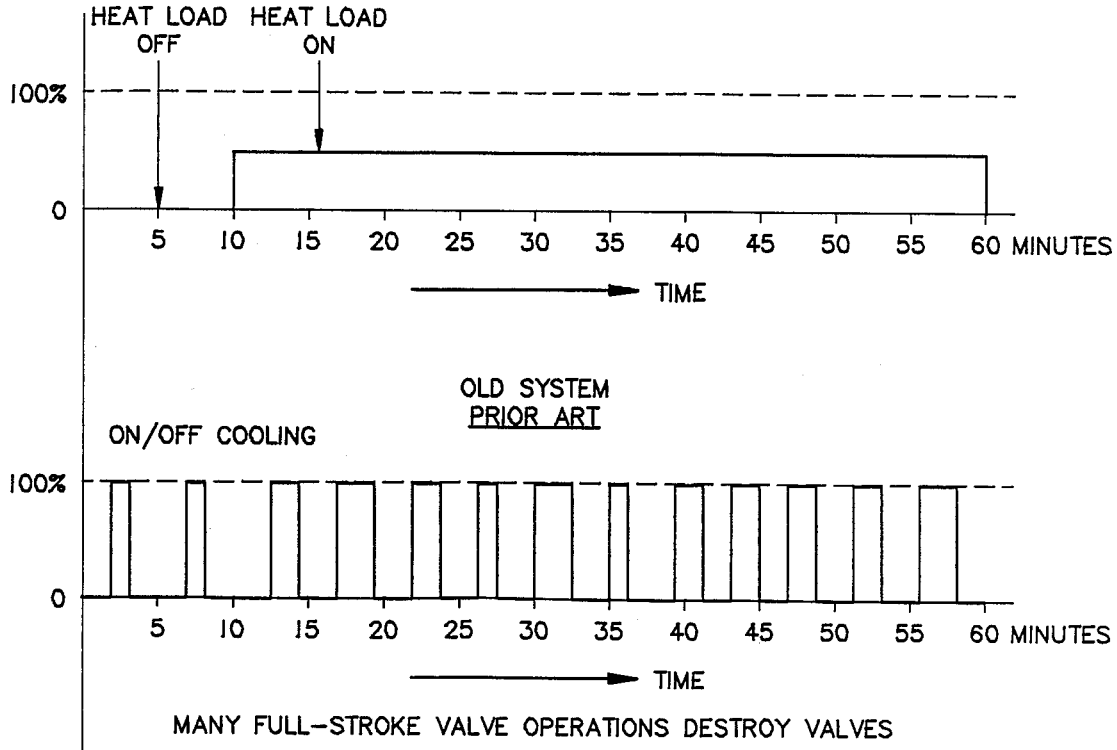
FIGS. 8*a* and 8*b* are graphs showing cooling work vs. time for prior art cycling systems and for systems of the invention, respectively.
Figure 8B:
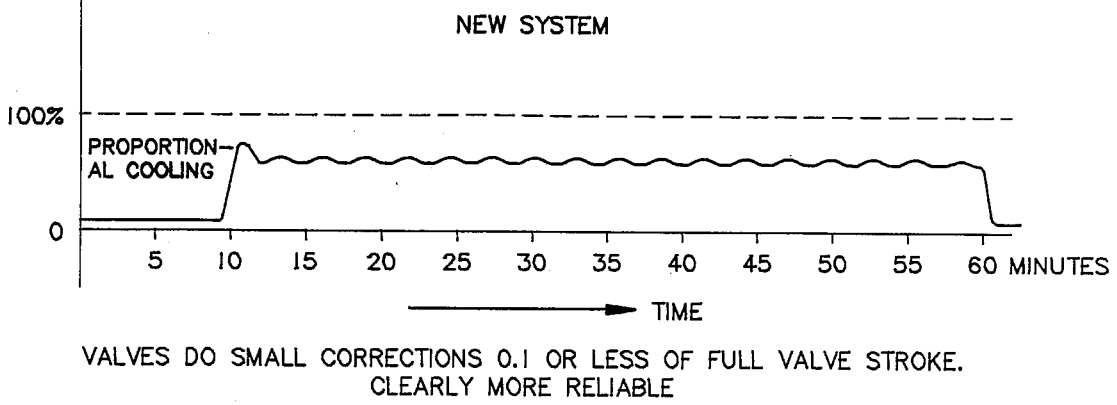

FIGS. 8*a* and 8*b* show generally a comparison of prior art system operation and the present system operation on the basis of cooling load vs. time.

Prior art systems were continually cycling on and off, between 100% cooling load and zero cooling load. The more their thermostats were set to closely maintain a set point temperature, the more often they cycled on and off. This is illustrated in FIG. 8*a*. Valves quickly failed under these conditions, and other components also failed due to cycling stress.

The systems of the invention, however, make smooth transitions and small adjustments in the proportional flow among main and bypass flow loops. FIG. 8*b* shows that when full cooling is demanded, at about 10 minutes, cooling is brought up to near-maximum by gradual shifting of valve positions. Then, the system gradually fluctuates as cooling work is done to move toward a set point temperature, generally making small corrections of about 10% or less of full valve stroke, at each valve involved. The valves would be the throttling valve 14 and the compressor-protecting valve 19, in the system of FIG. 1, in this mode prior to achieving of set point temperature. The bypass valve 17 can also be involved, in the event dangerous pressure (but not temperature) levels are approached.

In the beginning and at about 60 minutes in the graph of FIG. 8*b*, the set load has been removed. The cooling is reduced to minimum level as shown, which is slightly above zero as the system may be removing heat generated by a system pump.

As already briefly mentioned, the system 80 depicted in FIG. 9 employs a proportional flow hot gas valve 61 in a bypass loop which bypasses around the evaporator 15. In this system 80, the hot gas put out from the compressor unit 11 does not add any heat to the fluid body 16. At the present time, proportional hot gas valves, such as the valve 61 of the system 80 are expensive, and in some applications, it may be preferably to employ the heat exchanger 35 and vapor throttling valve 17 as shown in the embodiments of FIGS. 1 and 5. As the cost of hot gas valves decreases, the system 80 becomes more and more attractive from a cost point of view.

Figure 10:
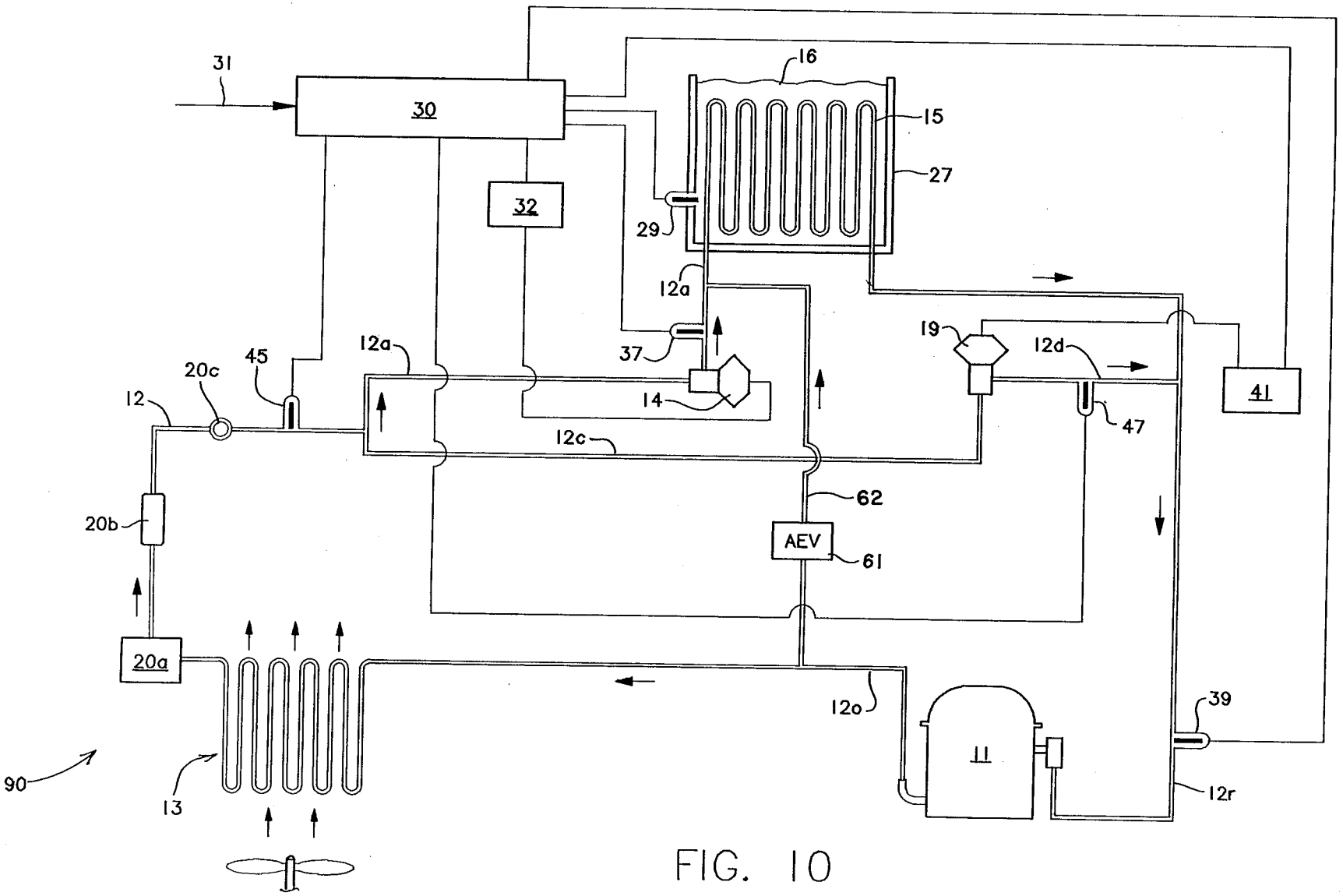
FIG. 10 is a schematic diagram of a single cooling channel refrigeration system in accordance with the principles of the present invention in which an automatic expansion valve (AEV) is provided for controlled delivery of hot gas to the evaporator.
Figure 11:
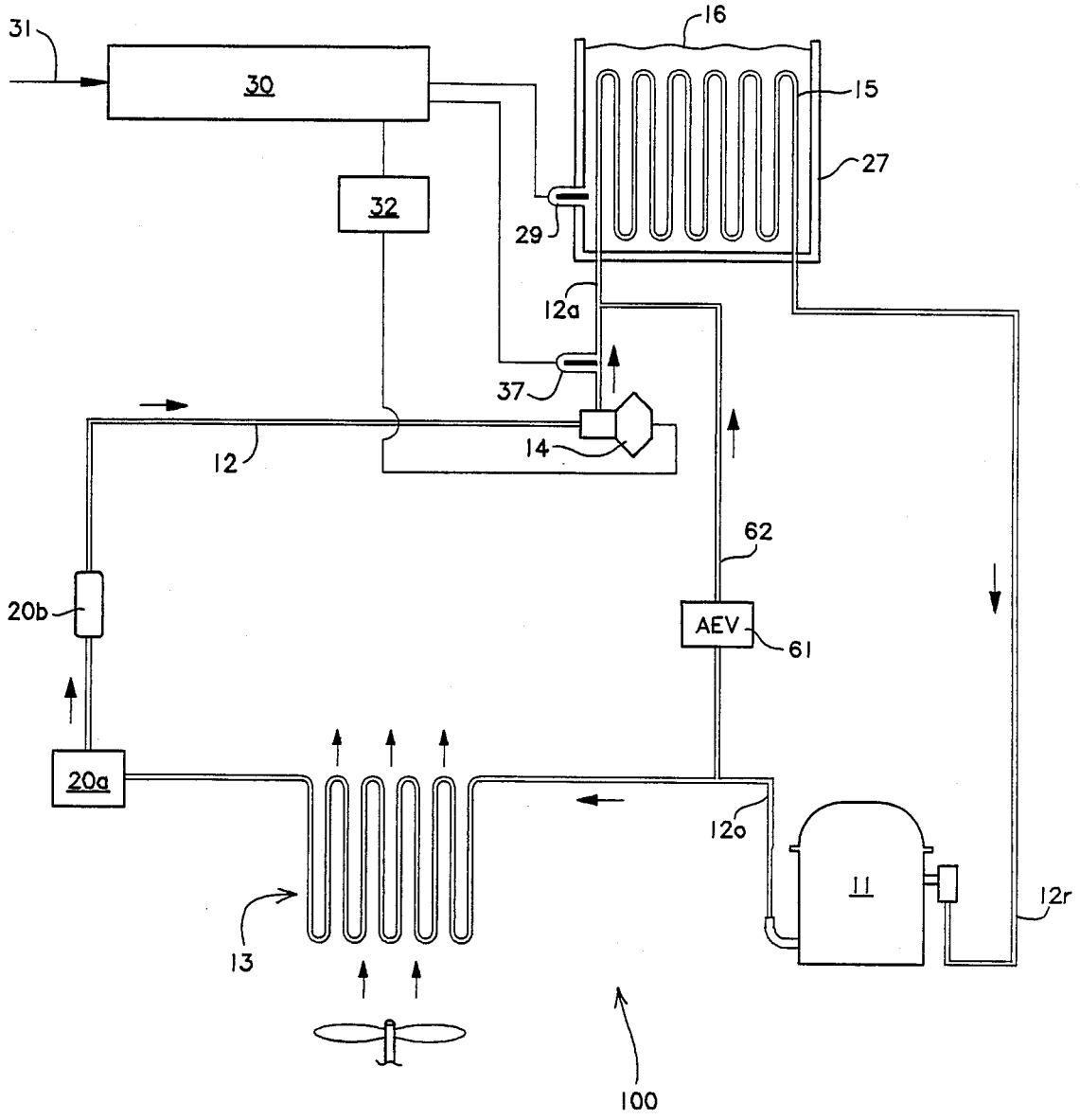
FIG. 11 is a schematic diagram of a simplified version of the FIG. 10 system.

The FIG. 10 system 90 and the FIG. 11 system 100 each employ an automatic expansion valve (AEV) 61 for hot gas bypass flow in place of a proportioning valve. The flow of hot gas will still be proportional as the throttling valve 14 modulates the flow of refrigerant into the evaporator 15 and will affect the pressure in the suction line 12*r*. The AEV 61, if it is set to maintain a minimum pressure in the suction line 12*r*, will flow proportionally and automatically the correct amount of hot gas in order to maintain that preset minimum pressure in the suction line 12*r*. In these two embodiments, the body of fluid to be cooled 16 is water, for example.

Figure 12:
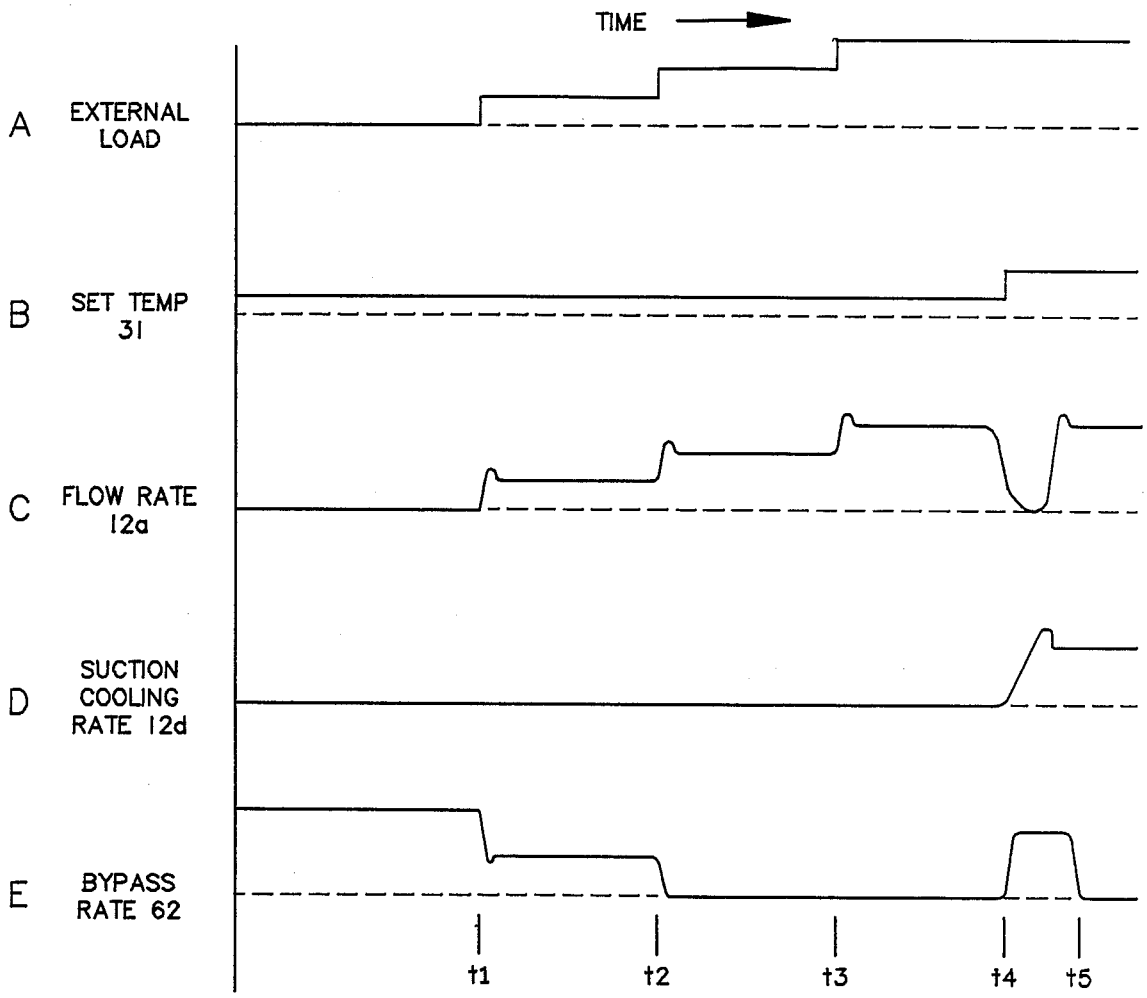
FIG. 12 is a graph showing operation of the FIG. 10 system at various times and under a variety of load and system conditions.

Operations of the FIGS. 10 and 11 systems 90 and 100 are depicted graphically in the FIG. 12 graphs of various system conditions and levels (ordinate axis) plotted against time (abscissa axis).

From the time T0 to the time T1, no external heat load is applied to the system by the body of fluid 16 which is at the set point temperature as sensed at the sensor 29 during the system's scan of all of the temperature sensors. In this condition of equilibrium there is no flow rate of coolant permitted by the throttling valve 14 into the evaporator 15. At the set point temperature of the body of water 16 the heat from the hot bypass gas flow through the AEV 61, the pipe 62 and the evaporator 15 is drawn off and removed by the flow or sumping capability of the cool water body 16, so that the gas entering the compressor through the suction return line 12*r* is at a safe temperature. In this condition, there is no bypass flow through the compressor protection valve 19 (FIG. 10 system 90) and if this condition is usual, then there is no need for the bypass loop (FIG. 11 system 100).

These quiescent conditions will be maintained until a change occurs. Such a change is depicted at time T1 at which time the load on the water body 16 goes up a significant first amount, as depicted in FIG. 12A. The temperature sensor 29 senses a small increase in the temperature of the water body 16, and a proportional flow rate, graphed in FIG. 12C, occurs to maintain the set temperature. The gas going into the compressor through the return pipe 12*r* is still sufficiently cool, so there is no suction cooling flow rate through the valve 19.

As refrigerant is now flowing through the evaporator 15, the flow rate through the hot gas bypass AEV 61 is diminished in order to maintain the preset pressure in the return pipe 12r.

At the time T2 the heat load is further increased. In order to maintain the set temperature, the flow rate through the evaporator is further increased as depicted in FIG. 12C. The temperature of the gas flowing into the return suction pipe 12r has remained below the temperature where it requires cooling by bypass flow through the valve 19. However, now there is sufficient refrigerant flowing through the valve 14 into the evaporator to exceed the minimum pressure requirements in the line 12r. There is no longer any flow through the bypass AEV 61, as shown in FIG. 12E.

At the time T3 the load is further increased as shown in FIG. 12A. This load increase is sensed, and the valve 14 is throttled up to flow more refrigerant through the evaporator coil 15 as shown in FIG. 12C in order to increase the cooling capacity applied to the water body 16. The temperature of gas flowing through the suction return line 12r to the compressor 11 has remained below the level at which it is necessary to cool it by opening valve 19, so there is still no suction bypass cooling flow rate, FIG. 12D. While the pressure in the return line 12r is further increased at time T3 there is still no necessity for any bypass flow through the AEV 61.

At time T4 the set temperature has been increased as shown in FIG. 12B. During the time that the body of water 16 is rising to the new set temperature, there is no cooling flow rate of refrigerant through the throttling valve 14, FIG. 12C. As the temperature of the body of water 16 increases, there becomes a need for suction cooling of the gas entering the compressor unit 11 through the pipe 12r. Thus, suction cooling flow begins during the time interval between the times T4 and T5, as shown in FIG. 12D.

As the cooling flow valve 14 has been closed, there is now a flow of gas through the AEV 61 in order to maintain adequate pressure in the pipe 12r into the compressor unit 11. This hot gas bypass contributes to the rising temperature of the body of water 16. As this body reaches the set point (the temperature sensor 29 senses actual temperature in the water body 16) and as there is still a heat load, the flow of refrigerant through the valve 14 to remove the heat generated by the load begins at line T5 as shown in FIG. 12C, and the AEV 61 closes. Now, the gas entering the compressor unit 11 via the line 12r is at the warmest point so far in the operational sequence described thus far, and there is now a flow rate through the suction cooling valve 19 as shown in FIG. 12D.

The system 100 shown in FIG. 11 does not include the suction cooling valve 19. The operation of the FIG. 11 system 100 is very similar to operation of the FIG. 10 system 90 with the exception that a higher set point temperature between times T4 and T5 as depicted in FIG. 12B would not be possible. Therefore, the system 100 depicted in FIG. 11 would be suitable for a cooling system to operate over a narrower temperature range, e.g. from 0° F. to 80° F. maximum.

It should also be noted in connection with FIG. 11 that the optional temperature sensor 45 in the pipe 12 has been omitted. This means that the FIG. 11 system 100 has no protection against operation in high ambient conditions. However, the simplified and cost-reduced system 100 will still provide all of the functions needed to achieve a high reliability chiller in that there are no sudden shock wave pressure changes of the type caused by conventional operation of solenoid valves. The flow of refrigerant through the evaporator 15 is still limited by the valve 14 so that the suction pressure in the line 12r will not exceed the maximum rating of the compressor unit 11. When the set point temperature is approached or reached, the flow into the evaporator 15 will proportion in response not just to the pressure or temperature in the suction line 12r but also to the temperature in the body of water 16 as sensed by the sensor 29. The flow of hot gas refrigerant to maintain pressure in the suction pipe 12r is still proportional as the AEV 61 becomes somewhat of a slave to operation of the proportional flow valve 14.

From the graphs of FIGS. 3, 6 through 8b and 12 it is seen that step function cycling of prior art refrigeration systems is avoided, and the smooth transitions of the present invention greatly increase the life of the compressor, all valves, and other components which would be subject to cycling stress. Typical frequent prior art metal fatigue and stress failures are avoided. Further, the systems of the invention prevent damage to the compressor and enable chilling to be provided in hostile environments which would keep some prior art systems from operating.

The systems shown and described herein are illustrative of the principles of the invention and are not meant to be limiting of its scope. Various other embodiments will be apparent to those skilled in the art and may be made without departing from the spirit and scope of the invention as defined by the following claims.

I claim:

1. A vapor-compression refrigeration system utilizing a liquid-gas refrigerant in a closed flow loop for maintaining a substantially constant set point temperature in a body of fluid to be cooled and having a continuously-operating compressor, a condenser downstream of the compressor in a main loop for cooling compressed gas refrigerant, and an evaporator in a first branch of the main loop, for transferring heat from the fluid to be cooled to the refrigerant, the system including a first, smoothly variable, analog refrigerant flow controllable throttling valve in the first branch immediately upstream from the evaporator, a second branch of the main loop bypassing said first throttling valve in said first branch and including a second, smoothly variable, analog refrigerant flow controllable throttling valve, and electrical control means, including first temperature sensor means for sensing temperature of the refrigerant immediately downstream of said first throttling valve, second temperature sensor means for sensing temperature of the body of fluid to be cooled and input means for receiving said set point temperatures for the fluid, said electrical control means for scanning the first and second temperature sensor means and the input means for generating a control value for each said throttling valve for modulating the flow rate of refrigerant through each said throttling valve in response to difference between set point temperature and sensed fluid temperature in a manner which enables said compressor to remain in continuous operation.

2. The system set forth in claim 1 comprising a second fluid flow loop leading from the compressor's outlet directly through the evaporator and back to the compressor's inlet and comprising a second fluid line leading from the main loop just downstream of the compressor, through a hot gas flow valve and back into the first line at a first point downstream of the throttling valve and upstream of the evaporator.

3. The system set forth in claim 2 wherein the hot gas flow valve comprises an automatic expansion valve (AEV).

4. The system of claim 1 wherein said system includes heat exchange means between the second branch downstream of said second throttling valve and the main loop just downstream of the compressor so that heat in the compressed refrigerant is transferred to the refrigerant flowing in the second branch.

5. The system of claim 4 wherein said second branch terminates downstream of said first throttling valve and upstream of said evaporator so that a precisely controllable amount of heat present in said refrigerant passing through said second branch may be transferred to the fluid body at the evaporator.

6. The system of claim 4 wherein said second branch terminates downstream of said evaporator so that refrigerant passing through said second branch is controllably transferable to the inlet of the compressor to limit the difference in pressure thereacross as derived from sensed temperatures of said refrigerant entering and leaving said compressor.

7. The system of claim 1, further comprising third temperature sensor means for determining the temperature of the refrigerant at a point just upstream of the inlet to the compressor, reflecting pressure at the inlet to the compressor and wherein said control means additionally scans said third temperature sensor means in order to determine temperature and derives therefrom the pressure of said refrigerant entering said compressor.

8. The system of claim 1 wherein the control means includes means for maintaining a substantially constant degree of superheat.

9. The system of claim 1 wherein said second branch terminates downstream of said evaporator so that refrigerant passing through said second branch may be transferred to the inlet of the compressor and further comprising third temperature sensor means for determining the temperature of the refrigerant at a point just upstream of the inlet to the compressor, and wherein said control means additionally scans said third temperature sensor means in order to determine temperature of said refrigerant entering said compressor, thereby to control operation of said second throttling valve to limit the temperature of refrigerant entering the compressor.

10. In a vapor-compression refrigeration system utilizing a liquid-gas coolant and having a continuouslyoperating compressor, a condenser, a throttling valve and an evaporator, a control system for maintaining a substantially constant selected temperature in a body of fluid to be cooled and for protecting the compressor of the system against overheating, comprising:

a first coolant fluid flow loop leading from an output of the compressor and ultimately back to an inlet of the compressor and comprising a first fluid line leading from the compressor's outlet through the condenser, through the throttling valve, through the evaporator and back to the inlet of the compressor, a second fluid flow loop leading from the compressor's outlet directly through the evaporator and back to the compressor's inlet and comprising a second fluid line leading from the first line, just downstream of the compressor, through a hot gas flow valve and back into the first line at a first point downstream of the throttling valve and upstream of the evaporator, a third fluid flow loop leading from the compressor's outlet through the condenser and then directly back to the compressor's inlet and including a third fluid line leading from the first line, at a point downstream of the condenser and upstream of the throttling valve, through a compressor-protecting valve and back into the first line at a second point downstream of the evaporator and upstream of the compressor, all of said valves comprising proportional-flow valves controllable to open to an extent demanded, and control means including temperature sensors and controllers regulating said throttling valve, said hot gas flow valve and said compressor-protecting valve for causing coolant fluid to flow substantially exclusively through said first loop under normal conditions wherein cooling is required in said body of fluid, for regulating inlet pressure to the compressor within preselected limits, for causing at least some of the coolant gas from the compressor to flow through said second loop when warming is required in said body of fluid, and to cause at least some of the coolant fluid in said first line to bypass through said third loop when the temperature of fluid entering the compressor becomes so high as to endanger the compressor, whereby the system operates to maintain said body of fluid substantially at the selected temperature in both hot and cold ambient temperatures through said first and second loops, unless the ambient temperature becomes too high for the compressor's range of operation, in which condition fluid is bypassed through said third loop to protect the compressor and cooling of said body of fluid is limited.

11. A proportional-flow refrigeration system utilizing liquid-gas coolant fluid and having a continuously-operating compressor, a condenser, a smoothly variable, proportional-flow throttling valve and an evaporator, for maintaining a body of load fluid at a substantially constant selected temperature, comprising, a first coolant fluid flow loop leading from an output of the compressor and ultimately back to an inlet of the compressor and comprising a first fluid line leading from the compressor's outlet through the condenser, through the throttling valve, through the evaporator and back to the inlet of the compressor, at least one flow controllable bypass flow loop for bypassing coolant from said frist fluid line from a point downstream of the condenser and upstream of the throttling valve, back to said first fluid line just upstream of the compressor's inlet, bypassing the throttling valve and the evaporator, sensor means including first temperature sensor means for determining temperature in the body of fluid to be cooled, and second temperature sensor means for determining temperature of the coolant fluid in the first line just upstream of the the compressor's inlet, control means in association with the sensor means, for normally opening the throttling valve when cooling is needed in said body of fluid and to an extent reflecting the difference between the actual temperature and the desired temperature of the body of fluid, for limiting the extent of opening at the throttle valve in accordance with a preselected limit for inlet pressure to the compressor in accordance with sensed temperature differential of the refrigerant entering and leaving the compressor, for controlling bypass of coolant fluid through said bypass flow loop when the temperature in the body of fluid approaches the desired temperature, proportionally in accordance with proximity to the desired temperature, and for controlling bypass of coolant fluid through said bypass flow loop when the second temperature sensor means determines that the temperature of coolant fluid entering the compressor approaches a preselected limit temperature, proportionally in accordance with proximity to said preselected limit temperature, whereby flow of gas is constant through the continuously-operating compressor, the compressor is protected against overheating, compressor inlet pressure is maintained within design limits, and transition between modes is smooth, protecting the system against shock.

12. A vapor-compression thermal load temperature control system utilizing a liquid-gas refrigerant in a closed flow loop for maintaining a substantially constant set point temperature in a thermal load to be cooled and having a continuously-operating compressor in the closed flow loop wherein the compressor transfers internally generated heat to refrigerant passing therethrough to operate below a maximum operating temperature, a condenser connected to a discharge segment downstream of the compressor in the closed flow loop for cooling compressed gas refrigerant discharged from the compressor, and an evaporator in a first branch of the closed flow loop for transferring heat from the thermal load to the refrigerant and returning warmed refrigerant to a suction inlet segment of the closed flow loop leading to a suction inlet of the continuously-operating compressor, the system including a first smoothly variable analog refrigerant flow controllable throttling valve in the first branch immediately upstream from the evaporator and first temperature sensor means immediately downstream from the first throttling valve for sensing temperature of the refrigerant at the evaporator, the system including a second branch of the closed flow loop extending from a midsegment of the closed flow loop downstream of the condenser and leading to the first branch immediately upstream of the evaporator, the second branch having a second smoothly variable analog refrigerant flow controllable throttling valve, a second temperature sensor means immediately downstream of the second throttling valve for sensing temperature of refrigerant leaving said second valve and a heat exchanger downstream of the second sensor means for transferring heat from compressed refrigerant flowing in the discharge segment to a controllable amount of vaporized refrigerant flowing in the second branch so that heat from the compressor may be transferred via the second branch to the thermal load via the evaporator, the system including a third branch of the closed flow loop extending from the midsegment and leading to the suction inlet segment, the third branch having a third smoothly variable analog refrigerant flow controllable throttling valve for providing a controllable amount of cooling to the suction inlet segment so that the compressor may be operated continuously below its upper thermal limit, and further including third temperature sensor means in the suction inlet segment for sensing temperature of refrigerant gas entering the compressor, and fourth temperature sensor means for sensing temperature of the thermal load, the system further including electrical control means for receiving a set point for the fluid as an electrical value from an external source including and converting sensed temperature into an electrical value, for receiving a set point for the fluid as an electrical value from an external source, for scanning said first, second and third temperature sensor means and for generating controls for modulating the flow rate of refrigerant through the first, second and third throttling valves by generating electrical control signals applied thereto so that said system may operate over a wide thermal range and approach thermal equalibrium between sensed thermal load temperature and set point temperature while enabling said compressor to operate continuously at an operating temperature below its maximum operating temperature.

* * * * *